US009755404B2

(12) United States Patent
Isasa et al.

(10) Patent No.: US 9,755,404 B2
(45) Date of Patent: Sep. 5, 2017

(54) SPARK PLUG

(71) Applicant: NGK Spark Plug Co., LTD., Nagoya (JP)

(72) Inventors: Jumpei Isasa, Nishikasugai-gun (JP); Haruki Yoshida, Tajimi (JP); Yutaka Yokoyama, Kasugai (JP); Kuniharu Tanaka, Komaki (JP); Nobuyoshi Araki, Nagoya (JP); Toshiki Kon, Komaki (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/265,152

(22) Filed: Sep. 14, 2016

(65) Prior Publication Data

US 2017/0093132 A1 Mar. 30, 2017

(30) Foreign Application Priority Data

Sep. 24, 2015 (JP) ..... 2015-186375

(51) Int. Cl.
*H01T 13/38* (2006.01)

(52) U.S. Cl.
CPC ..... *H01T 13/38* (2013.01)

(58) Field of Classification Search
CPC ..... H01T 13/38
See application file for complete search history.

(56) References Cited

U.S. PATENT DOCUMENTS

2001/0004184 A1 6/2001 Ito et al.
2010/0136867 A1 6/2010 Kurono et al.
(Continued)

FOREIGN PATENT DOCUMENTS

JP 2001-155546 A 6/2001
JP 2014-187004 A 10/2014
WO WO-2009/119098 A 10/2009

*Primary Examiner* — Donald Raleigh
*Assistant Examiner* — Kevin Quarterman
(74) *Attorney, Agent, or Firm* — Leason Ellis LLP

(57) ABSTRACT

A spark plug includes an insulator made of an alumina sintered body containing $Al_2O_3$ as a principal component and additional components including; an Si component, a Ba component, an Mg component, a Ca component, an Sr component, and a rare earth element component. When the additional components are expressed as oxides including $R_{SiO2}$, $R_{BaO}$, $R_{MgO}$, $R_{CaO}$, $R_{SrO}$, and $R_{RE2O3}$, contents (mass %) of the sub-component satisfy expressions (1) to (6) as follows: (1) $1.0 \leq R_{SiO2} \leq 5.0$; (2) $0.5 \leq R_{BaO} \leq 5.0$; (3) $0 \leq R_{MgO} \leq 0.18$; (4) $0 \leq R_{MgO}/R_{BaO} \leq 0.36$; (5) $0.3 \leq (R_{MgO}+R_{CaO}+R_{SrO}) \leq 1.8$; and (6) $0 \leq R_{RE2O3} \leq 0.1$.

6 Claims, 2 Drawing Sheets

(56) References Cited

U.S. PATENT DOCUMENTS

| | | | | |
|---|---|---|---|---|
| 2012/0007489 | A1* | 1/2012 | Kurono | C04B 35/113 313/141 |
| 2014/0243184 | A1 | 8/2014 | Fujimura et al. | |

* cited by examiner

SPARK PLUG

This application claims the benefit of Japanese Patent Application No. 2015-186375, filed Sep. 24, 2015, which is incorporated herein in its entirety by reference.

FIELD OF THE INVENTION

The present invention relates to spark plugs each including an insulator capable of maintaining withstand voltage performance under a high temperature environment over a long term.

BACKGROUND ART OF THE INVENTION

Spark plugs for use in internal combustion engines such as automobile engines each have a spark plug insulator (also referred to simply as "insulator") formed from, for example, an alumina-based sintered material containing alumina ($Al_2O_3$) as a principal component. This insulator is formed from such an alumina-based sintered material because the alumina-based sintered material is excellent in heat resistance, mechanical strength, and the like. In order to obtain such an alumina-based sintered material, for example, a three-component sintering aid composed of, for example, silicon oxide ($SiO_2$), calcium monoxide (CaO), and magnesium monoxide (MgO) has been used for the purpose of lowering the firing temperature and improving sinterability.

The temperature in a combustion chamber of an internal combustion engine to which such a spark plug is attached sometimes reaches about 700° C., for example. Therefore, the spark plug is required to exert excellent withstand voltage performance in a temperature range from the room temperature to about 700° C. Alumina-based sintered materials have been proposed which are suitably used for insulators or the like of spark plugs exerting the withstand voltage performance.

For example, Japanese Patent Application Laid-Open (kokai) No. 2001-155546 discloses " . . . an insulator for a spark plug, which comprises an alumina-based sintered body comprising: $Al_2O_3$ (alumina) as a main component; and at least one component (hereinafter referred to as "E. component") selected from the group consisting of Ca (calcium) component, Sr (strontium) component and Ba (barium) component, wherein at least part of the alumina-based sintered body comprises particles comprising a compound comprising the E. component and Al (aluminum) component, the compound having a molar ratio of the Al component to the E. component of 4.5 to 6.7 as calculated in terms of oxides thereof, and has a relative density of 90% or more." (see claim 1 of Japanese Patent Application Laid-Open (kokai) No. 2001-155546). Japanese Patent Application Laid-Open (kokai) No. 2001-155546 indicates that this technique can provide a spark plug having an insulator which is less liable to occurrence of dielectric breakdown due to the effect of residual pores or low-melting glass phases present on boundaries of the alumina-based sintered body, and exhibits a higher dielectric strength at a temperature as high as around 700° C. than the conventional materials (see, for example, paragraph [0007] of Japanese Patent Application Laid-Open (kokai) No. 2001-155546).

Meanwhile, PCT International Publication No. WO 2009/119098, for the purpose of providing a spark plug having an insulator that exerts high withstand voltage characteristics and high-temperature strength (see paragraph [0014] of PCT International Publication No. WO 2009/119098), discloses "A spark plug . . . the insulator is formed from a dense alumina-based sintered material having a mean crystal grain size $D_A$ (Al) of 1.50 μm or more; the alumina-based sintered material contains an Si component and, among configured to transmit torque on substantially a 1:1 basis between its proximal and group 2 elements (the Group included in the periodic table defined by Recommendations 1990, IUPAC), Mg and Ba, as essential components, and a group 2 element (2A) component containing at least one element other than Mg and Ba, and a rare earth element (RE) component, wherein the ratio of the Si component content S (oxide-reduced mass %) to the sum (S+A) of S and the group 2 element (2A) component content A (oxide-reduced mass %) is 0.60 or higher" (see claim 1 of PCT International Publication No. WO 2009/119098).

Japanese Patent Application Laid-Open (kokai) 2014-187004, for the purpose of improving the strength and the withstand voltage performance, discloses "an insulator . . . wherein a ratio between a content of a rare earth element as reduced to oxide and expressed in percent by mass and a content of a group 2 element (included in the periodic table defined by Recommendations 1990, IUPAC) as reduced to oxide and expressed in percent by mass, satisfies 0.1≤content of rare earth element/content of group 2 element≤1.4, and a ratio between the content of the rare earth element and a content of barium oxide as reduced to oxide and expressed in percent by mass, satisfies 0.2≤content of barium oxide/content of rare earth element≤0.8, wherein at least one virtual rectangular frame of 7.5 μm×50 μm that encloses a crystal containing the rare earth element is present in an arbitrary region of 630 μm×480 μm at a cross section of the sintered body, and an occupation ratio of an area of the crystal containing the rare earth element to an area of the rectangular frame is 5% or more, and when the rectangular frame is divided into three division regions in a direction of a long side thereof, among occupation ratios of areas of the crystal containing the rare earth element in the respective division regions, a ratio between the occupation ratio of the maximum area and the occupation ratio of the minimum area is 5.5 or less" (see claim 1 of Japanese Patent Application Laid-Open (kokai) 2014-187004).

Problems to be Solved by the Invention

In recent years, the temperature in the combustion chamber tends to be increased for high output and improved fuel efficiency of the internal combustion engine. With this, the insulator as a component of the spark plug may be exposed to a higher temperature than before, for example, about 900° C. In addition, for long maintenance intervals, the spark plug is desired to be able to maintain its performance for a long term. Therefore, an insulator is desired which is excellent in withstand voltage performance under a high temperature environment of about 900° C., and is able to maintain the performance for a long term. In the patent documents described above, it is not assumed that the insulator is exposed to such a high temperature environment of about 900° C. Therefore, the insulators disclosed in the patent documents described above cannot achieve a sufficient level of withstand voltage performance under a high temperature environment of about 900° C.

An objective of the present invention is to provide a spark plug including an insulator capable of maintaining withstand voltage performance under a high temperature environment for a long term.

SUMMARY OF THE INVENTION

Means for Solving the Problems

Means for solving the above problems is,

[1] A spark plug including: an insulator having an axial bore extending in a direction of an axis; a center electrode provided at a front side of the axial bore; a metallic shell provided on an outer periphery of the insulator; and a ground electrode fixed to a front end of the metallic shell, wherein the insulator is made of an alumina sintered body containing $Al_2O_3$ as a principal component and further containing additional components including an Si component, a Ba component, an Mg component, a Ca component, an Sr component, and a rare earth element component, and when the additional components are expressed as oxides including $R_{SiO2}$, $R_{BaO}$, $R_{MgO}$, $R_{CaO}$, $R_{SrO}$, and $R_{RE2O3}$, contents (mass %) of the additional components satisfy expressions (1) to (6) as follows:

$$1.0 \leq R_{SiO2} \leq 5.0 \quad (1)$$

$$0.5 \leq R_{BaO} \leq 5.0 \quad (2)$$

$$0 \leq R_{MgO} \leq 0.18 \quad (3)$$

$$0 \leq R_{MgO}/R_{BaO} \leq 0.36 \quad (4)$$

$$0.3 \leq (R_{MgO}+R_{CaO}+R_{SrO}) \leq 1.8 \quad (5)$$

$$0 \leq R_{RE2O3} \leq 0.1 \quad (6)$$

Preferable modes of the above [1] are as follows.

[2] In the spark plug according to the above [1], the contents of additional components satisfy an expression (7) as follows:

$$0.10 \leq R_{CaO}/(R_{MgO}+R_{CaO}+R_{SrO}+R_{BaO}) \leq 0.50 \quad (7)$$

[3] In the spark plug according to the above [1] or [2], the contents of additional components satisfy an expression (8) as follows:

$$0.06 \leq (R_{MgO}+R_{CaO}+R_{SrO})/R_{BaO} \leq 1.25 \quad (8)$$

[4] In the spark plug according to any one of the above [1] to [3], the alumina sintered body further contains a Na component and a K component whose combined content is not less than 0.002 mass % and not greater than 0.050 mass %.

[5] In the spark plug according to any one of the above [1] to [4], the alumina sintered body further contains a Ti component and an Fe component whose combined content is not less than 0.01 mass % and not greater than 0.08 mass %.

[6] In the spark plug according to any one of the above [1] to [5], the alumina sintered body further contains barium hexaaluminate.

[7] In the spark plug according to any one of the above [1] to [6], the alumina sintered body has a ratio $D_A/D_B$ that is not smaller than 0.5 and not larger than 5.0, where $D_A$ is an average value of maximum diameters of a plurality of alumina crystal grains, and $D_B$ is an average value of maximum diameters of crystal grains containing the Ba component.

Effects of the Invention

The insulator according to the present invention is made of the alumina sintered body containing $Al_2O_3$ as a principal component and further containing additional components including the Si component, the Ba component, the Mg component, the Ca component, the Sr component, and the rare earth element component, which satisfy the above expressions (1) to (6). Therefore, when the spark plug has been used for a long term under an environment in which the insulator is exposed to a high temperature, for example, about 900° C., the insulator has sufficient withstand voltage performance. Therefore, according to the present invention, it is possible to provide a spark plug including an insulator capable of maintaining withstand voltage performance for a long term under a high temperature environment.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
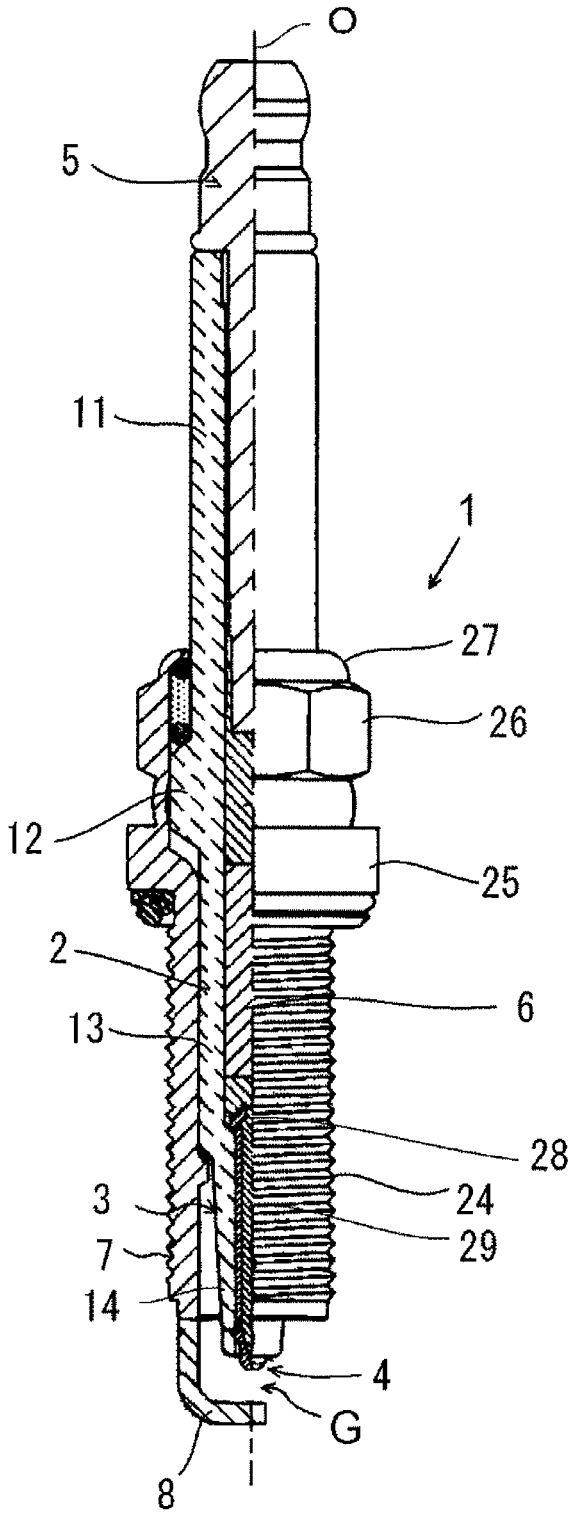
FIG. 1 is a partially sectional explanatory view of a spark plug which is one embodiment of a spark plug according to the present invention.

A spark plug which is one embodiment of a spark plug according to the present invention is shown in FIG. 1. FIG. 1 is a partially sectional explanatory view of a spark plug 1 which is one embodiment of a spark plug according to the present invention. In FIG. 1, the downward direction on the sheet, i.e., the direction toward the side at which a later-described ground electrode is disposed, is a frontward direction along an axis O, and the upward direction on the sheet is a rearward direction along the axis O.

As shown in FIG. 1, this spark plug 1 includes: a substantially cylindrical insulator 3 having an axial bore 2 that extends in the direction of the axis O; a substantially rod-shaped center electrode 4 provided at the front side in the axial bore 2; a metal terminal 5 provided at the rear side in the axial bore 2; a connection portion 6 disposed between the center electrode 4 and the metal terminal 5 in the axial bore 2; a substantially cylindrical metallic shell 7 provided on the outer periphery of the insulator 3; and a ground electrode 8 having a base end portion fixed to a front end of the metallic shell 7, and a front end portion opposed to the center electrode 4 via a gap G.

The insulator 3 has the axial bore 2 extending in the direction of the axis O, and has a substantially cylindrical shape. The insulator 3 includes a rear trunk portion 11, a large diameter portion 12, a front trunk portion 13, and a leg portion 14. The rear trunk portion 11 houses the metal terminal 5, and insulates the metal terminal 5 and the metallic shell 7 from each other. The large diameter portion 12 is disposed on the front side relative to the rear trunk portion 11, and projects radially outward. The front trunk portion 13 is disposed on the front side relative to the large diameter portion 12, has an outer diameter smaller than that of the large diameter portion 12, and houses the connection portion 6. The leg portion 14 is disposed on the front side relative to the front trunk portion 13, has an outer diameter and an inner diameter smaller than those of the front trunk portion 13, and houses the center electrode 4. The insulator 3 is fixed to the metallic shell 7, with an end portion, in the frontward direction, of the insulator 3 projecting from a front end face of the metallic shell 7. The insulator 3 is formed from a material having mechanical strength, thermal strength, and electrical insulation property. The insulator 3, which is a feature of the present invention, will be described later in detail.

The connection portion 6 is disposed between the center electrode 4 and the metal terminal 5 in the axial bore 2. The connection portion 6 fixes the center electrode 4 and the metal terminal 5 in the axial bore 2, and electrically connects therebetween.

The metallic shell 7 has a substantially cylindrical shape, and is formed such that the metallic shell 7 holds the insulator 3 when the insulator 3 is inserted therein. The metallic shell 7 has a screw portion 24 formed on an outer peripheral surface thereof in the frontward direction. The screw portion 24 is used for mounting the spark plug 1 to a cylinder head of an internal combustion engine which is not shown. The metallic shell 7 has a flange-shaped gas seal portion 25 at the rear side of the screw portion 24, and has a tool engagement portion 26 for engaging a tool such as a spanner or a wrench at the rear side of the gas seal portion 25, and a crimping portion 27 at the rear side of the tool engagement portion 26. The front end portion of the inner peripheral surface of the screw portion 24 is disposed so as to form a space with respect to the leg portion 14. The metallic shell 7 may be formed from a conductive steel material such as low-carbon steel.

The metal terminal 5 is a terminal for applying a voltage from the outside to the center electrode 4 so as to cause spark discharge between the center electrode 4 and the ground electrode 8. The metal terminal 5 is inserted into the axial bore 2 and fixed by the connection portion 6, with a part thereof being exposed from the rear end side of the insulator 3. The metal terminal 5 may be formed from a metal material such as low-carbon steel.

The center electrode 4 has a rear end portion 28 in contact with the connection portion 6, and a rod-shaped portion 29 extending toward the front side from the rear end portion 28. The center electrode 4 is fixed in the axial bore 2 of the insulator 3, with a front end thereof projecting from the front end of the insulator 3, whereby the center electrode 4 is insulated from and held by the metallic shell 7. The rear end portion 28 and the rod-shaped portion 29 of the center electrode 4 may be formed from a known material used for the center electrode 4, such as an Ni alloy. The center electrode 4 may be formed by an outer layer formed from an Ni alloy or the like, and a core portion that is formed from a material having a higher coefficient of thermal conductivity than the Ni alloy, and formed so as to be concentrically embedded in an axial portion within the outer layer. Examples of such a material of the core portion may include Cu, a Cu alloy, Ag, an Ag alloy, and pure Ni.

The ground electrode 8 is formed into, for example, a substantially prismatic shape. Specifically, the ground electrode 8 is formed such that the base end portion is joined to the front end portion of the metallic shell 7, an intermediate portion thereof is bent in a substantially L shape, and the front end portion is opposed to a front end of the center electrode 4 with a gap G therebetween. In the present embodiment, the gap G represents the shortest distance between the front end of the center electrode 4 and the side surface of the ground electrode 8. The gap G is usually set to be 0.3 to 1.5 mm. The ground electrode 8 may be formed from a known material used for the ground electrode 8, such as an Ni alloy. Like the center electrode 4, the ground electrode 8 may be composed of an outer layer formed from an Ni alloy or the like, and a core portion that is formed from a material having a higher coefficient of thermal conductivity than the Ni alloy, and formed so as to be concentrically embedded in an axial portion within the outer layer.

Hereinafter, the insulator, which is a feature of the present invention, will be described in detail.

The insulator 3 is made of an alumina sintered body containing $Al_2O_3$ as a principal component and further containing additional components including an Si component, a Ba component, an Mg component, a Ca component, an Sr component, and a rare earth element component, and when the additional components are expressed as oxides including $R_{SiO2}$, $R_{BaO}$, $R_{MgO}$, $R_{CaO}$, $R_{SrO}$, and $R_{RE2O3}$, respectively, contents (mass %) of the additional components satisfy expressions (1) to (6) as follows:

$$1.0 \leq R_{SiO2} \leq 5.0 \quad (1)$$

$$0.5 \leq R_{BaO} \leq 5.0 \quad (2)$$

$$0 \leq R_{MgO} \leq 0.18 \quad (3)$$

$$0 \leq R_{MgO}/R_{BaO} 0.36 \quad (4)$$

$$0.3 \leq (R_{MgO}+R_{CaO}+R_{SrO}) \leq 1.8 \quad (5)$$

$$0 \leq R_{RE2O3} \leq 0.1 \quad (6)$$

The insulator 3 is made of the alumina sintered body containing $Al_2O_3$ as a principal component. The contents of additional components including the Si component, the Ba component, the Mg component, the Ca component, the Sr component, and the rare earth element component satisfy the above expressions (1) to (6). Therefore, when the spark plug has been used for a long term under an environment in which the insulator 3 formed from the alumina sintered body is exposed to a high temperature, for example, about 900° C., the insulator 3 has sufficient withstand voltage performance. Thus, according to the present invention, it is possible to provide a spark plug including an insulator capable of maintaining withstand voltage performance under a high temperature environment for a long term.

The alumina sintered body that forms the insulator 3 contains $Al_2O_3$ as a principal component. That is, in the alumina sintered body, the ratio of the mass of the Al component as reduced to oxide, to the total mass, as reduced to oxides, of elements detected when the alumina sintered body is subjected to fluorescent X-ray analysis is the largest, preferably, not less than 91 mass % and not greater than 97 mass %, and more preferably, not less than 94.5 mass % and not greater than 95.5 mass %. Most of the Al component is present as a crystal of alumina in the alumina sintered body. Part of the Al component is present in glass phases and in crystals other than alumina. The alumina sintered body is excellent in withstand voltage performance, mechanical strength, and the like when the content ratio of the Al component as reduced to oxide is within the above-mentioned range. When the content ratio of the Al component as reduced to oxide exceeds 97 mass %, sinterability is degraded, and sufficient withstand voltage performance cannot be obtained. When the content ratio of the Al component as reduced to oxide is less than 91 mass %, the ratio of the glass phases relatively increases, whereby the glass phases are softened at a high temperature, for example, about 900° C., and sufficient withstand voltage performance cannot be obtained.

The Si component is present in the alumina sintered body in the form of oxide, ion, or the like. The Si component melts during sintering to usually form liquid phases, and therefore serves as a sintering aid which promotes densification of the alumina sintered body. After completion of sintering, the Si component is present as glass phases or as a crystal other than alumina together with another element such as Al. In the alumina sintered body, the Si component content ratio $R_{SiO2}$ is the ratio of the mass of the Si component as reduced to oxide, to the total mass of the elements, as reduced to oxides, detected when the alumina sintered body is subjected to fluorescent X-ray analysis. Regarding the content ratio $R_{SiO2}$ of the Si component, the alumina sintered body satisfies (1) $1.0 \leq R_{SiO2} \leq 5.0$, and preferably satisfies $2.0 \leq R_{SiO2} \leq 4.0$. When the Si component content ratio $R_{SiO2}$ is less than 1.0 mass %, sinterability is degraded, which makes it difficult to obtain a dense alumina sintered body. Consequently, sufficient withstand voltage performance cannot be obtained. When the Si component content ratio $R_{SiO2}$ exceeds 5.0 mass %, the ratio of the glass phases increases. In this case, the glass phases are softened at a high temperature, for example, about 900° C., and sufficient withstand voltage performance cannot be obtained.

The alumina sintered body contains the Ba component as an essential component, and contains at least one of the Mg component, the Ca component, and the Sr component. The Ba component, the Mg component, the Ca component, and the Sr component are present in the alumina sintered body in the form of oxides, ions, or the like. Each of the Ba component, the Mg component, the Ca component, and the Sr component melts during sintering to usually form liquid phases, and therefore serves as a sintering aid which promotes densification of the sintered material. After completion of sintering, each of the Ba component, the Mg component, the Ca component, and the Sr component is present as glass phases or as a crystal other than alumina together with another element such as Al. In the alumina sintered body, the Ba component content ratio $R_{BaO}$, the Mg component content ratio $R_{MgO}$, the Ca component content ratio $R_{CaO}$, and the Sr component content ratio $R_{SrO}$ are the ratios of the masses of the Ba component, the Mg component, the Ca component, and the Sr component as reduced to oxides, respectively, to the total mass of the elements, as reduced to oxides, detected when the alumina sintered body is subjected to fluorescent X-ray analysis.

Regarding the Ba component content ratio $R_{BaO}$, the alumina sintered body satisfies (2) $0.5 \leq R_{BaO} \leq 5.0$, and preferably satisfies $1.2 \leq R_{BaO} \leq 3.0$. When the spark plug 1 is used over a long term, that is, when a voltage is continuously applied to the insulator 3 under a high temperature environment, migration occurs, and atoms of group 2 elements, such as Mg, Ca, Sr, and Ba, included in the periodic table defined by Recommendations 1990, IUPAC, may migrate from a positive electrode of the insulator 3 to a negative electrode thereof. For example, when the inner peripheral surface of the axial bore 2 of the insulator 3 forms the positive electrode and the outer peripheral surface thereof forms the negative electrode, the atoms of the group 2 elements migrate from the inner peripheral surface of the insulator 3 toward the outer peripheral surface thereof. With the migration of the atoms of the group 2 elements, voids are formed in an area from which the atoms have migrated, and the voids serve as starting points of dielectric breakdown, resulting in a reduction in insulating performance. On the other hand, the heavier an element is, that is, the larger the atomic number of the element is, the lesser the atoms of the element migrate when a voltage is applied. Therefore, among the group 2 element components contained in the alumina sintered body as sintering aids, if the Ba component having the largest atomic number is contained, occurrence of migration can be suppressed, whereby the withstand voltage performance can be improved. When the Ba component content ratio $R_{BaO}$ is less than 0.5 mass %, the content ratios of the group 2 element components other than the Ba component are relatively increased in order to ensure the sinterability. In this case, occurrence of migration cannot be suppressed, and the insulating performance is degraded. Therefore, when the spark plug 1 has been used over a long term under an environment in which the insulator 3 is exposed to a high temperature, for example, about 900° C., sufficient withstand voltage performance cannot be obtained. When the Ba component content ratio $R_{BaO}$ exceeds 5.0 mass %, the sinterability is degraded, and many voids are formed inside the insulator 3. Also in this case, sufficient withstand voltage performance cannot be obtained.

Regarding the Mg component content ratio $R_{MgO}$, the alumina sintered body satisfies (3) $0 \leq R_{MgO} \leq 0.18$. Among the group 2 elements, Mg has the smallest atomic number, and is likely to cause migration when a voltage is applied under a high temperature environment. When the Mg component content ratio $R_{MgO}$ exceeds 0.18 mass %, occurrence of migration cannot be suppressed, and the insulating performance is reduced. Therefore, when the spark plug 1 has been used over a long term under an environment in which the insulator 3 is exposed to a high temperature, for example, about 900° C., sufficient withstand voltage performance cannot be obtained.

Regarding the ratio ($R_{MgO}/R_{BaO}$) of the Mg component content ratio $R_{MgO}$ to the Ba component content ratio $R_{BaO}$, the alumina sintered body satisfies (4) $0 \leq R_{MgO}/R_{BaO} \leq 0.36$. Among the group 2 elements, Mg has the smallest atomic number, and is likely to cause migration when a voltage is applied under a high temperature environment. On the other hand, among the group 2 elements, Ba has the largest atomic number, and is less likely to cause migration when a voltage is applied under a high temperature environment. When the ratio ($R_{MgO}/R_{BaO}$) is larger than 0.36, occurrence of migration cannot be suppressed, and the insulating performance is reduced. Therefore, when the spark plug 1 has been used over a long term under an environment in which the insulator 3 is exposed to a high temperature, for example, about 900° C., sufficient withstand voltage performance cannot be obtained.

Regarding the sum ($R_{MgO}+R_{CaO}+R_{SrO}$) of the Mg component content ratio $R_{MgO}$, the Ca component content ratio $R_{CaO}$, and the Sr component content ratio $R_{SrO}$, the alumina sintered body satisfies (5) $0.3 \leq (R_{MgO}+R_{CaO}+R_{SrO}) \leq 1.8$. The alumina sintered body contains at least one of the Mg component, the Ca component, and the Sr component. When the Ba component content ratio is excessively large among the group 2 elements serving as sintering aids, the sinterability is degraded, and sufficient withstand voltage performance cannot be obtained. In order to obtain an alumina sintered body having favorable sinterability, it is conceivable to increase the firing temperature. However, an increase in the firing temperature causes a burden imposed on a furnace, which may result in an increase in the manufacturing cost. Therefore, it is desired to achieve favorable sinterability at a low firing temperature. When the alumina sintered body contains not only the Ba component having the largest atomic number among the group 2 elements but also at least one of the Mg component, the Ca component, and the Sr component so as to satisfy the expression (5), favorable sinterability can be achieved without increasing the firing temperature, and occurrence of migration can be suppressed. Therefore, when the spark plug 1 has been used for a long term under an environment in which the insulator 3 is exposed to a high temperature, for example, about 900° C., sufficient withstand voltage performance can be obtained. When the sum of the content ratios ($R_{MgO}+R_{CaO}+R_{SrO}$) is less than 0.3 mass %, the sinterability is degraded, and sufficient withstand voltage performance cannot be obtained. When the sum of the content ratios ($R_{MgO}+R_{CaO}+R_{SrO}$) is greater than 1.8 mass %, since Mg, Ca, and Sr have smaller atomic numbers than Ba, migration is likely to occur when a voltage is applied under a high temperature environment, and sufficient withstand voltage performance cannot be obtained.

Regarding the Ca component content ratio $R_{CaO}$ as reduced to oxide to the sum ($R_{MgO}+R_{CaO}+R_{SrO}+R_{BaO}$) of the Mg component content ratio, the Ca component content ratio, the Sr component content ratio, and the Ba component content ratio as reduced to oxides, the alumina sintered body preferably satisfies (7) $0.10 \leq R_{CaO}/(R_{MgO}+R_{CaO}+R_{SrO}+R_{BaO}) \leq 0.50$. The Ca component provides favorable sinterability without increasing the firing temperature, and therefore is preferably contained in the alumina sintered body. More preferably, the Ca component is contained so as to satisfy $0.10 \leq R_{CaO}/(R_{MgO}+R_{CaO}+R_{SrO}+R_{BaO})$. Meanwhile, Ca has the smallest atomic number next to that of Mg, and is likely to cause migration when a voltage is applied under a high temperature environment. Therefore, when the content ratio of the Ca component to the group 2 element components contained in the alumina sintered body is excessively large, occurrence of migration cannot be suppressed. When the alumina sintered body contains the Ca component so as to satisfy the expression (7), favorable sinterability can be obtained without increasing the firing temperature, and occurrence of migration can be suppressed. Therefore, when the spark plug 1 has been used for a long term under an environment in which the insulator 3 is exposed to a high temperature, for example, about 900° C., more sufficient withstand voltage performance can be obtained.

Regarding the sum ($R_{MgO}+R_{CaO}+R_{SrO}$) of the Mg component content ratio, the Ca component content ratio, and the Sr component content ratio as reduced to oxides to the Ba component content ratio $R_{BaO}$ as reduced to oxide, the alumina sintered body preferably satisfies (8) $0.06 \leq (R_{MgO}+R_{CaO}+R_{SrO})/R_{BaO} \leq 1.25$. When the alumina sintered body contains not only the Ba component having the largest atomic number among the group 2 element components but also at least one of the Mg component, the Ca component, and the Sr component so as to satisfy the above expression (8), favorable sinterability can be obtained without increasing the firing temperature, and occurrence of migration can be suppressed. Therefore, when the spark plug 1 has been used for a long term under an environment in which the insulator 3 is exposed to a high temperature, for example, about 900° C., more sufficient withstand voltage performance can be obtained.

When the alumina sintered body contains the rare earth element component, the rare earth element component is present in the alumina sintered body in the form of oxide, ion, or the like. The rare earth element component content ratio $R_{RE2O3}$ is the ratio of the mass of the rare earth element component as reduced to oxide, to the total mass of the elements, as reduced to oxides, detected when the alumina sintered body is subjected to fluorescent X-ray analysis. Regarding the rare earth element component content ratio $R_{RE2O3}$, the alumina sintered body satisfies (6) $0 \leq R_{RE2O3} \leq 0.1$. When the Ba component content ratio in the alumina sintered body is relatively large, the sinterability is degraded with an increase in the rare earth element component content ratio, and sufficient withstand voltage performance cannot be obtained. In order to obtain an alumina sintered body with favorable sinterability, it is conceivable to increase the firing temperature. However, an increase in the firing temperature causes an increase in the manufacturing cost of the alumina sintered body. Therefore, it is preferable that the alumina sintered body contains no rare earth element component. If the alumina sintered body contains the rare earth element component, the rare earth element component content ratio $R_{RE2O3}$ is preferably 0.1 mass % or less. Examples of the rare earth element component include an Sc component, a Y component, an La component, a Ce component, a Pr component, an Nd component, a Pm component, an Sm component, an Eu component, a Gd component, a Tb component, a Dy component, an Ho component, an Er component, a Tm component, a Yb component, and an Lu component.

The content ratio of each component contained in the alumina sintered body can be obtained as follows. First, the spark plug 1 is cut along a plane orthogonal to the axis O to expose a cut surface. Subsequently, the cut surface of the insulator 3 is mirror-polished to obtain a polished surface. Then, fluorescent X-ray analysis is performed at any five points on the polished surface, and the ratio of the mass of the Al component as reduced to oxide to the total mass of the elements, as reduced to oxides, detected through the fluorescent X-ray analysis is calculated. Then, an arithmetic average of the obtained values is calculated, thereby calculating the content ratio (mass %) of the Al component. Likewise, the content ratios (mass %) $R_{SiO2}$, $R_{BaO}$, $R_{MgO}$, $R_{CaO}$, $R_{SrO}$, and $R_{RE2O3}$ of the Si component, the Ba component, the Mg component, the Ca component, the Sr component, and the rare earth element component as reduced to oxides are calculated.

When the total mass of the alumina sintered body is 100 mass %, the sum of the content ratios of a Na component and a K component is preferably not less than 0.002 mass % and not greater than 0.050 mass %. The Na component and the K component are present mainly in the glass phases in the form of oxide, ion, or the like. The smaller the content ratio of the Na component and the K component is, the more the softening temperature of the glass phases increases and the more the withstand voltage performance under a high temperature environment is improved. The content ratio of the Na component and the K component is preferred to be smaller. However, when the content ratio of the Na component and the K component is 0.050 mass % or less, the effect achieved by increasing the softening temperature of the glass phases reaches a peak. In addition, when the content ratio of the Na component and the K component is 0.050 mass % or less, even if migration of Na atoms and K atoms occurs, sufficient withstand voltage performance can be obtained when the spark plug 1 has been used for a long term under an environment in which the insulator 3 is exposed to a high temperature, for example, about 900° C. The alumina sintered body sometimes contains the Na component and the K component as unavoidable impurities. Therefore, the alumina sintered body may contain 0.002 mass % or more of the Na component and the K component.

When the total mass of the alumina sintered body is 100 mass %, the sum of the content ratios of a Ti component and a Fe component in the alumina sintered body is preferably not less than 0.01 mass % and not greater than 0.08 mass %. The Ti component and the Fe component are present mainly in the glass phases as oxides, ions, or the like. When the content ratio of the Ti component and the Fe component is 0.08 mass % or less, sufficient withstand voltage performance can be obtained when the spark plug 1 has been used for a long term under an environment in which the insulator 3 is exposed to a high temperature, for example, about 900° C., although the reason for this is unknown. The alumina sintered body sometimes contains the Ti component and the Fe component as unavoidable impurities. Therefore, the alumina sintered body may contain 0.01 mass % or more of the Ti component and the Fe component.

The content ratios of the minor components such as the Na component, the K component, the Ti component, and the Fe component in the alumina sintered body can be obtained by ICP atomic emission spectroscopy, as the mass ratios of the respective elements to the total mass of the analysis sample.

The alumina sintered body preferably contains a crystal containing the Ba component as a crystal other than the crystal of alumina. As an example of the crystal containing the Ba component, there is a crystal containing the Ba component and the Al component. Examples of such a crystal include $BaO.6Al_2O_3$ (barium hexaaluminate), $BaAl_2Si_{28}$ (celsian), and $BaAl_{12}O_{19}$. In the crystal containing the Ba component, such as barium hexaaluminate, a part of Ba may be replaced with Mg, Ca, or Sr. Since the crystal containing the Ba component has a layered structure, if the alumina sintered body contains the crystal containing the Ba component, the migration paths of Mg atoms, Ca atoms, and the like are increased when migration occurs. Therefore, in the alumina sintered body containing the crystal including the Ba component, even if migration occurs and atoms migrate when a voltage is applied to the insulator 3 under a high temperature environment, it is possible to suppress degradation in the withstand voltage performance due to the long-term use of the spark plug 1.

The types of the crystals contained in the alumina sintered body can be confirmed by, for example, subjecting the alumina sintered body to X-ray diffraction analysis, and contrasting an X-ray diffraction chart obtained through the X-ray diffraction with a JCPDS card, for example.

In the alumina sintered body, a ratio ($D_A/D_B$) between an average grain size $D_A$ which is an average value of the maximum diameters of a plurality of alumina crystal grains and an average grain size $D_B$ which is an average value of the maximum diameters of the crystal grains containing the Ba component is preferably not smaller than 0.5 and not larger than 5.0. When the ratio ($D_A/D_B$) is not smaller than 0.5 and not larger than 5.0, the migration paths of Mg atoms, Ca atoms, and the like when migration occurs can be further increased, whereby degradation in the withstand voltage performance due to the long-term use of the spark plug 1 can be further suppressed.

The ratio ($D_A/D_B$) can be adjusted by changing: the raw material compositions in manufacturing the alumina sintered body; or the firing conditions in firing a molded body of raw material powder, such as the rate of temperature increase, the firing temperature, the rate of temperature decrease, and the like.

The ratio ($D_A/D_B$) can be obtained as follows, for example. First, the spark plug 1 is cut along a plane orthogonal to the axis O to expose a cut surface. Subsequently, in order to observe only crystals at the cut surface of the insulator 3, the spark plug 1 with the exposed cut surface is put in a furnace and held at 1400° C. for one hour, thereby performing thermal etching. Then, the cut surface of the insulator 3 is observed with a scanning electron microscope (SEM). For example, in an area having a length of 300 μm and a width of 300 μm, five alumina crystal grains and five crystal grains containing the Ba component are selected, and the maximum diameter of each crystal grain is measured. In each of 10 fields of view, five alumina crystal grains and five crystal grains containing the Ba component are selected in a similar manner as described above, and the maximum diameter of each crystal grain is measured. For each crystal, an average value of the maximum diameters of the 50 crystal grains in total is calculated. The average value of the maximum diameters of the alumina crystal grains is the average grain size $D_A$, and the average value of the maximum diameters of the crystal grains containing the Ba component is the average grain size $D_B$. The ratio ($D_A/D_B$) between the average grain size $D_A$ and the average grain size $D_B$ is calculated. In each viewing field, element analysis is performed with an energy dispersive X-ray spectrometer (EDS) attached to the SEM, whereby the alumina crystal and the crystal containing the Ba component can be specified.

The spark plug 1 is manufactured as follows, for example. First, a method of manufacturing the insulator 3, which is a feature of the present invention, will be described.

First, at least one of raw material powders, i.e., Al compound powder, Si compound powder, Ba compound powder, Mg compound powder, Ca compound powder, and Sr compound powder, and earth element compound powder as desired are blended at a predetermined ratio and mixed in a slurry. The mixing ratios of the respective powders can be set to be the same as, for example, the content ratios of the respective components in the alumina sintered body that forms the insulator 3. This mixing is preferably performed over 8 hours or more so that the raw material powders are uniformly mixed and the sintered body obtained is highly densified.

The Al compound powder is not particularly limited as long as the compound can be converted to an Al component by firing. Usually, alumina ($Al_2O_3$) powder is adopted. Since the Al compound powder sometimes contains unavoidable impurities such as Na or the like, high-purity Al compound powder is desirably adopted. For example, the purity of the Al compound powder is preferably 99.5% or more. In order to obtain a densified alumina sintered body, Al compound powder having an average grain size of 0.1 to 5.0 μm is preferably used.

The Si compound powder is not particularly limited as long as the compound can be converted to an Si component by firing. Examples thereof may include various inorganic powders such as oxide (including composite oxide), hydroxide, carbonate, chloride, sulfate, nitrate and phosphate of Si. Specific examples thereof may include $SiO_2$ powder. In the case where powder other than oxide is used as the Si compound powder, the used amount thereof is figured out by mass % in terms of oxide. The purity and the average grain size of the Si compound powder are fundamentally the same as those of the Al compound powder.

The Ba compound powder is not particularly limited as long as the compound can be converted to a Ba component by firing. Examples thereof may include various inorganic powders such as oxide (including composite oxide), hydroxide, carbonate, chloride, sulfate, nitrate and phosphate of Ba. Specific examples of the Ba compound powder may include BaO powder and $BaCO_3$ powder. In the case where powder other than oxide is used as the Ba compound powder, the used amount thereof is figured out by mass % in terms of oxide. The purity and the average grain size of the Ba compound powder are fundamentally the same as those of the Al compound powder.

The Mg compound powder is not particularly limited as long as the compound can be converted to an Mg component by firing. Examples thereof may include various inorganic powders such as oxide (including composite oxide), hydroxide, carbonate, chloride, sulfate, nitrate and phosphate of Mg. Specific examples of the Mg compound powder may include MgO powder and $MgCO_3$ powder. In the case where powder other than oxide is used as the Mg compound powder, the used amount thereof is figured out by mass % in terms of oxide. The purity and the average grain size of the Mg compound powder are fundamentally the same as those of the Al compound powder.

The Ca compound powder is not particularly limited as long as the compound can be converted to a Ca component by firing. Examples thereof may include various inorganic powders such as oxide (including composite oxide), hydroxide, carbonate, chloride, sulfate, nitrate and phosphate of Ca. Specific examples of the Ca compound powder may include CaO powder and $CaCO_3$ powder. In the case where powder other than oxide is used as the Ca compound powder, the used amount thereof is figured out by mass % in terms of oxide. The purity and the average grain size of the Ca compound powder are fundamentally the same as those of the Al compound powder.

The Sr compound powder is not particularly limited as long as the compound can be converted to an Sr component by firing. Examples thereof may include various inorganic powders such as oxide (including composite oxide), hydroxide, carbonate, chloride, sulfate, nitrate and phosphate of Sr. Specific examples of the Sr compound powder may include SrO powder and $SrCO_3$ powder. In the case where powder other than oxide is used as the Sr compound powder, the used amount thereof is figured out by mass % in terms of oxide. The purity and the average grain size of the Sr compound powder are fundamentally the same as those of the Al compound powder.

The rare earth element compound powder that is optionally added is not particularly limited as long as the compound can be converted to a rare earth element component by firing. Examples thereof may include oxide (including composite oxide) of a rare earth element. In the case where powder other than oxide is used as the rare earth element compound powder, the used amount thereof is figured out by mass % in terms of oxide. The purity and the average grain size of the rare earth element compound powder are fundamentally the same as those of the Al compound powder.

The raw material powders are dispersed in the solvent and are mixed in the slurry with, for example, a hydrophilic binder being blended as a binder. Examples of the solvent adopted may include water and alcohol. Examples of the hydrophilic binder may include polyvinyl alcohol, water-soluble acrylic resin, gum arabic, and dextrin. These hydrophilic binders or solvents may be used singly or in combination of two or more species. Regarding the amounts of the hydrophilic binder and the solvent to be used, when the raw material powder is 100 parts by mass, the hydrophilic binder is 0.1 to 5.0 parts by mass, preferably 0.5 to 3.0 parts by mass, and water used as the solvent is 40 to 120 parts by mass, preferably 50 to 100 parts by mass.

Subsequently, thus produced slurry is spray-dried through spray drying or the like and granulated so as to have the average grain size of 50 to 200 μm, preferably 70 to 150 μm. The average grain size is a value measured through a laser diffraction method (microtrac grain size distribution measuring apparatus (MT-3000), product of Nikkiso Co., Ltd.).

Subsequently, the granulated product is press-molded through, for example, rubber pressing or metal mold pressing, to yield an unfired molded body preferably having the shape and dimensions of the insulator 3. The outer surface of the obtained unfired molded body is polished by means of resinoid grind stone or the like, to work the unfired molded body into a desired shape.

The unfired molded body polished and finished into the desired shape is heated in air atmosphere from the room temperature to a predetermined temperature within a range of 1500 to 1700° C., preferably a range of 1550 to 1650° C., at a temperature increase rate of 5 to 15° C./min, and is fired at this temperature for 1 to 8 hours, preferably 3 to 7 hours, and thereafter, the firing temperature is decreased to the room temperature at a temperature decrease rate of 3 to 20° C./min, whereby an alumina sintered body is obtained. When the temperature increase rate is 5 to 15° C./min, cracking caused by vaporization of organic components in the unfired molded body can be suppressed, whereby withstand voltage performance and mechanical strength of the obtained alumina sintered body can be ensured. When the firing temperature is 1500 to 1700° C., the alumina sintered body has favorable sinterability even if the alumina sintered body contains a relatively large amount of the Ba component, and anomalous grain growth of the alumina component is less likely to occur, whereby a densified alumina sintered body can be obtained. Also, when the firing time is 1 to 8 hours, anomalous grain growth of the alumina component is less likely to occur, and the sintered body is sufficiently densified. Further, when the temperature decrease rate is 3 to 20° C./min, the alumina crystal and the crystal containing the Ba component, each having a desired grain size, are easily formed. Therefore, when the temperature increase rate, the firing temperature, the firing time, and the temperature decrease rate are within the above-described ranges in firing the unfired molded body, it is possible to obtain an alumina sintered body having sufficient withstand voltage performance when the spark plug 1 has been used for a long term under an environment in which the insulator 3 is exposed to a high temperature, for example, about 900° C.

As described above, the insulator 3 formed from the alumina sintered body is obtained. The spark plug 1 including the insulator 3 is manufactured as follows, for example. That is, an electrode material such as an Ni alloy is worked to specific shape and dimensions to form the center electrode 4 and the ground electrode 8. Preparation and working of the electrode material may be performed sequentially. For example, a melt of an Ni alloy or the like having a desired composition is prepared by means of a vacuum melting furnace, and an ingot is prepared from the melt through vacuum casting. Then, the ingot is subjected to appropriate working processes such as hot working and wire drawing so as to have desired shape and dimensions, thereby producing the center electrode 4 and the ground electrode 8.

Subsequently, one end portion of the ground electrode 8 is joined, through electric resistance welding or the like, to the end surface of the metallic shell 7 formed through plastic working or the like to desired shape and dimensions. Then, the center electrode 4 is incorporated into the axial bore 2 of the insulator 3 through a known technique, and the axial bore 2 is filled with a composition for forming the connection portion 6 while preliminary compressing the composition. Subsequently, the composition is compressed and heated while the metal terminal 5 is pressed in through an end portion in the axial bore 2. Thus, the composition is sintered to form the connection portion 6. Subsequently, the insulator 3 to which the center electrode 4 and the like are fixed is assembled to the metallic shell 7 to which the ground electrode 8 is joined. Finally, a front end portion of the ground electrode 8 is bent toward the center electrode 4 such that one end of the ground electrode 8 is opposed to the front end portion of the center electrode 4, whereby the spark plug 1 is manufactured.

The spark plug 1 according to the present invention is used as an ignition plug for an internal combustion engine for an automobile, such as a gasoline engine. The spark plug 1 is fixed at a predetermined position by the screw portion 24 being screwed into a screw hole provided in a head (not shown) which defines a combustion chamber of the internal combustion engine. The spark plug 1 according to the present invention can be used for any internal combustion engine. The insulator 3 in the spark plug 1 according to the present invention can maintain the withstand voltage performance even when a voltage is applied thereto for a long term under a high temperature environment of, for example, 900° C., and therefore is particularly suitable for an internal combustion engine in which the insulator 3 is exposed to a high temperature, for example, 900° C.

The spark plug 1 according to the present invention is not limited to the above-described embodiment, and various changes can be made as long as the purpose of the present invention can be accomplished.

Examples (Production of Insulator)

As shown in Tables 1 to 7, raw material powder was prepared by appropriately mixing $Al_2O_3$ powder, $SiO_2$ powder, $BaCO_3$ powder, $MgCO_3$ powder, $CaCO_3$ powder, $SrCO_3$ powder, $La_2O_3$ powder, $Na_2CO_3$ powder, $K_2CO_3$ powder, $Fe_2O_3$ powder, and $TiO_2$ powder. To the raw material powder, water serving as a solvent and a hydrophilic binder were added to prepare a slurry.

The prepared slurry was spray-dried through a spray drying method to granulate the slurry into powder having an average grain size of about 100 μm. This powder was press-molded to form an unfired molded body as a green compact of a test insulator 70. The unfired molded body was heated in air atmosphere from the room temperature to a predetermined firing temperature within a range of 1500 to 1700° C. at a temperature increase rate in a range of 5 to 15° C./min, and was fired at this firing temperature for a firing time set within a range of 1 to 8 hours, and thereafter the temperature was decreased to the room temperature at a temperature decrease rate within a range of 3 to 20° C./min. Thus, a test insulator 70 with a lid, having a shape shown in FIG. 2, was obtained.

(Measurement of Composition and the Like of Test Insulator)

The produced test insulator 70 was cut along a plane orthogonal to the axial direction, and the cut surface was polished to obtain a polished surface. The polished surface was subjected to fluorescent X-ray analysis, and a ratio of the mass of an Al component as reduced to oxide to the total mass of detected elements as reduced to oxides was calculated. Similar measurement was performed at five locations, and an arithmetic average of all the measured values was calculated to obtain the content ratio $R_{Al2O3}$ of the Al component. In a similar manner, the content ratios $R_{SiO2}$, $R_{BaO}$, $R_{MgO}$, $R_{CaO}$, $R_{SrO}$, and $R_{RE2O3}$ of the Si component, the Ba component, the Mg component, the Ca component, the Sr component, and the La component, respectively, as reduced to oxides were calculated. On the basis of these values, various numerical values shown in Tables 1 to 7 were calculated.

In "high-temperature withstand voltage test I" described later, the test insulator 70 was subjected to X-ray diffraction analysis to identify crystals contained in the test insulator 70.

In "high-temperature withstand voltage test IV" described later, the content ratios of minute components such as Na, K, Fe, and Ti contained in the test insulator 70 were measured through ICP emission spectrochemical analysis.

(Measurement of Crystal Grain Size)

In "high-temperature withstand voltage test I" described later, a ratio ($D_A/D_B$) between the average grain size $D_A$ of the alumina crystal and the average grain size $D_B$ of the crystal containing the Ba component, which crystals are contained in the alumina sintered body, was obtained by means of a scanning electron microscope (SEM). Specifically, first, the test insulator 70 having the exposed cut surface, which was used for measurement of the composition of the test insulator 70, was put in an electric furnace and held at 1400° C. for 1 hour, whereby the test insulator 70 was subjected to thermal etching. Subsequently, the cut surface of the test insulator 70 was observed by means of the scanning electron microscope (SEM). As described above, in the area having a length of 300 μm and a width of 300 μm, over 10 fields of view, the maximum diameters of 50 crystal grains were measured for each of the alumina crystal and the crystal containing the Ba component, and an average value of the measured values was calculated. The average value of the maximum diameters of the alumina crystal grains was the average grain size $D_A$, and the average value of the maximum diameters of the crystal grains containing the Ba component was the average grain size $D_B$. The ratio ($D_A/D_B$) between the average grain size $D_A$ and the average grain size $D_B$ was calculated. In each field of view, element analysis was performed by means of an energy dispersive X-ray spectrometer (EDS) attached to the SEM to specify the alumina crystal and the crystal containing the Ba component.

(High-Temperature Withstand Voltage Test I)

Figure 2:
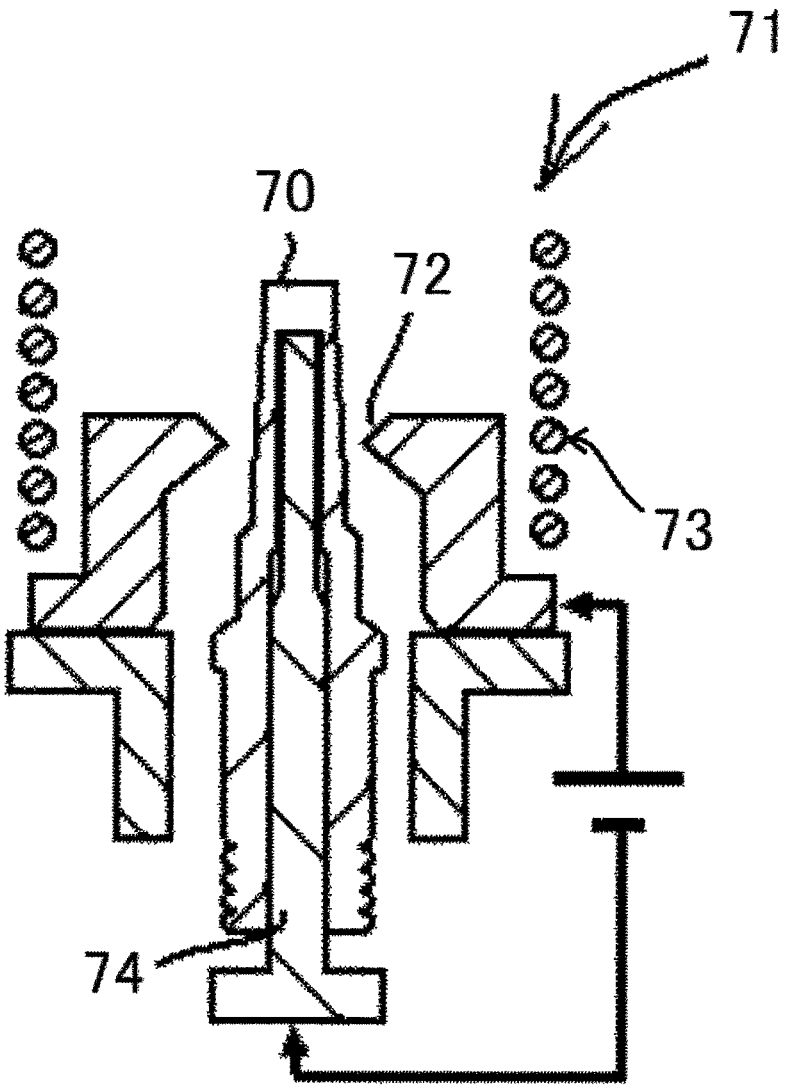
FIG. 2 is a cross-sectional explanatory view schematically showing a withstand voltage measuring apparatus used for a high-temperature withstand voltage test.

By using a withstand voltage measuring apparatus 71 shown in FIG. 2, the test insulator 70 was subjected to a high-temperature withstand voltage test at 900° C. As shown in FIG. 2, the produced test insulator 70 has the axial bore in the center thereof along the axial direction, and a lid is provided at the front end portion of the axial bore so as to close the axial bore. The withstand voltage measuring apparatus 71 includes a metallic annular member 72, and a furnace having a heater 73 for heating the test insulator 70. A test center electrode 74 made of an Ni alloy was inserted into the axial bore of the test insulator 70 to reach the front end portion of the axial bore, and the annular member 72 was disposed so that the inner peripheral surface of the annular member 72 contacts the outer peripheral surface of the front end portion of the test insulator 70. In this state, the withstand voltage of the test insulator 70 was measured. Specifically, first, the test insulator 70 was put in the furnace, and heated by the heater 73 until the temperature in the furnace reached 900° C. Then, a voltage of 20 kV was applied for 30 minutes between the test center electrode 74 and the annular member 72 in the furnace being kept at 900° C. Thus, an accelerated aging test was performed to make the test insulator 70 similar to an insulator included in a spark plug used for a long term. Thereafter, a voltage was applied between the test center electrode 74 and the annular member 72, and increased at a rate of 0.5 kV/s. A voltage value was measured when dielectric breakdown occurred in the test insulator 70, that is, when the test insulator 70 was perforated and the voltage was not further increased, and this voltage value was entered in Tables 1 to 3 as a withstand voltage value (kV).

TABLE 1

| Test No. | | $R_{Al2O3}$ | $R_{SiO2}$ | $R_{MgO}$ | $R_{CaO}$ | $R_{SrO}$ | $R_{BaO}$ | $R_{La2O3}$ | $R_{MgO}/R_{BaO}$ | $R_{MgO} + R_{CaO} + R_{SrO}$ | After application of 20 kV at 900° C. for 30 min Withstand voltage value (kV) |
|---|---|---|---|---|---|---|---|---|---|---|---|
| | | (mass %) | | | | | | | | | |
| 1 | Ex. | 94.81 | 3.0 | 0.18 | 0.4 | 0.01 | 1.6 | 0.00 | 0.113 | 0.59 | 30 |
| 2 | Ex. | 94.81 | 3.0 | 0.18 | 0.4 | 0.01 | 1.6 | 0.10 | 0.113 | 0.59 | 28 |
| 3 | Com. Ex. | 94.81 | 3.0 | 0.18 | 0.4 | 0.01 | 1.6 | 0.30 | 0.113 | 0.59 | 23 |
| 4 | Ex. | 96.81 | 1.0 | 0.18 | 0.4 | 0.01 | 1.6 | 0.00 | 0.113 | 0.59 | 28 |
| 5 | Com. Ex. | 97.31 | 0.5 | 0.18 | 0.4 | 0.01 | 1.6 | 0.00 | 0.113 | 0.59 | 21 |
| 6 | Ex. | 92.81 | 5.0 | 0.18 | 0.4 | 0.01 | 1.6 | 0.00 | 0.113 | 0.59 | 27 |
| 7 | Com. Ex. | 89.81 | 8.0 | 0.18 | 0.4 | 0.01 | 1.6 | 0.00 | 0.113 | 0.59 | 20 |
| 8 | Ex. | 95.01 | 3.0 | 0.18 | 0.4 | 0.01 | 1.4 | 0.00 | 0.129 | 0.59 | 27 |
| 9 | Ex. | 95.21 | 3.0 | 0.18 | 0.4 | 0.01 | 1.2 | 0.00 | 0.150 | 0.59 | 28 |
| 10 | Ex. | 95.71 | 3.0 | 0.18 | 0.4 | 0.01 | 0.7 | 0.00 | 0.257 | 0.59 | 27 |
| 11 | Ex. | 95.91 | 3.0 | 0.18 | 0.4 | 0.01 | 0.5 | 0.00 | 0.360 | 0.59 | 26 |
| 12 | Ex. | 91.41 | 3.0 | 0.18 | 0.4 | 0.01 | 5.0 | 0.00 | 0.036 | 0.59 | 27 |
| 13 | Com. Ex. | 96.11 | 3.0 | 0.18 | 0.4 | 0.01 | 0.3 | 0.00 | 0.600 | 0.59 | 18 |
| 14 | Com. Ex. | 90.41 | 3.0 | 0.18 | 0.4 | 0.01 | 6.0 | 0.00 | 0.030 | 0.59 | 18 |
| 15 | Ex. | 95.91 | 3.0 | 0.18 | 0.4 | 0.01 | 0.5 | 0.00 | 0.360 | 0.59 | 27 |
| 16 | Com. Ex. | 96.01 | 3.0 | 0.18 | 0.4 | 0.01 | 0.4 | 0.00 | 0.450 | 0.59 | 23 |
| 17 | Com. Ex. | 95.89 | 3.0 | 0.20 | 0.4 | 0.01 | 0.5 | 0.00 | 0.400 | 0.61 | 23 |
| 18 | Ex. | 95.02 | 3.0 | 0.18 | 0.1 | 0.10 | 1.6 | 0.00 | 0.113 | 0.38 | 28 |
| 19 | Ex. | 95.1 | 3.0 | 0.00 | 0.3 | 0.00 | 1.6 | 0.00 | 0.000 | 0.30 | 28 |
| 20 | Ex. | 95.1 | 3.0 | 0.00 | 0.0 | 0.30 | 1.6 | 0.00 | 0.000 | 0.30 | 28 |
| 21 | Com. Ex. | 95.4 | 3.0 | 0.00 | 0.0 | 0.00 | 1.6 | 0.00 | 0.000 | 0.00 | 15 |
| 22 | Com. Ex. | 95.3 | 3.0 | 0.10 | 0.0 | 0.00 | 1.6 | 0.00 | 0.063 | 0.10 | 17 |
| 23 | Com. Ex. | 95.3 | 3.0 | 0.00 | 0.1 | 0.00 | 1.6 | 0.00 | 0.000 | 0.10 | 17 |
| 24 | Ex. | 93.71 | 3.0 | 0.18 | 1.5 | 0.01 | 1.6 | 0.00 | 0.113 | 1.69 | 28 |
| 25 | Ex. | 93.42 | 3.0 | 0.18 | 0.4 | 1.00 | 2.0 | 0.00 | 0.090 | 1.58 | 28 |
| 26 | Ex. | 93.72 | 3.0 | 0.18 | 0.8 | 0.70 | 1.6 | 0.00 | 0.113 | 1.68 | 28 |
| 27 | Com. Ex. | 94.09 | 3.0 | 0.90 | 0.4 | 0.01 | 1.6 | 0.00 | 0.563 | 1.31 | 15 |
| 28 | Com. Ex. | 93.21 | 3.0 | 0.18 | 2.0 | 0.01 | 1.6 | 0.00 | 0.113 | 2.19 | 17 |
| 29 | Com. Ex. | 93.22 | 3.0 | 0.18 | 0.4 | 1.60 | 1.6 | 0.00 | 0.113 | 2.18 | 17 |

TABLE 2

| Test No. | | $R_{Al2O3}$ | $R_{SiO2}$ | $R_{MgO}$ | $R_{CaO}$ | $R_{SrO}$ | $R_{BaO}$ | $R_{La2O3}$ | Presence/absence of $BaO \bullet 6Al_2O_3$ | After application of 20 kV at 900° C. for 30 min Withstand voltage value (kV) |
|---|---|---|---|---|---|---|---|---|---|---|
| | | (mass %) | | | | | | | | |
| 31 | Ex. | 94.81 | 3.0 | 0.18 | 0.4 | 0.01 | 1.6 | 0.00 | Present | 30 |
| 32 | Ex. | 94.81 | 3.0 | 0.18 | 0.4 | 0.01 | 1.6 | 0.00 | Present | 29 |
| 33 | Ex. | 94.81 | 3.0 | 0.18 | 0.4 | 0.01 | 1.6 | 0.00 | Present | 28 |
| 34 | Ex. | 94.81 | 3.0 | 0.18 | 0.4 | 0.01 | 1.6 | 0.00 | Present | 30 |
| 35 | Ex. | 94.81 | 3.0 | 0.18 | 0.4 | 0.01 | 1.6 | 0.00 | Present | 30 |
| 36 | Ex. | 94.81 | 3.0 | 0.18 | 0.4 | 0.01 | 1.6 | 0.00 | Absent | 22 |
| 37 | Ex. | 94.81 | 3.0 | 0.18 | 0.4 | 0.01 | 1.6 | 0.00 | Absent | 21 |

TABLE 3

| Test No. | | $R_{Al2O3}$ | $R_{SiO2}$ | $R_{MgO}$ | $R_{CaO}$ | $R_{SrO}$ | $R_{BaO}$ | $R_{La2O3}$ | Ratio ($D_A/D_B$) | After application of 20 kV at 900° C. for 30 min Withstand voltage value (kV) |
|---|---|---|---|---|---|---|---|---|---|---|
| | | (mass %) | | | | | | | | |
| 41 | Ex. | 94.81 | 3.0 | 0.18 | 0.4 | 0.01 | 1.6 | 0.00 | 3.0 | 30 |
| 42 | Ex. | 94.81 | 3.0 | 0.18 | 0.4 | 0.01 | 1.6 | 0.00 | 1.0 | 29 |
| 43 | Ex. | 94.81 | 3.0 | 0.18 | 0.4 | 0.01 | 1.6 | 0.00 | 5.0 | 28 |
| 44 | Ex. | 94.81 | 3.0 | 0.18 | 0.4 | 0.01 | 1.6 | 0.00 | 0.7 | 30 |
| 45 | Ex. | 94.81 | 3.0 | 0.18 | 0.4 | 0.01 | 1.6 | 0.00 | 0.5 | 30 |
| 46 | Ex. | 94.81 | 3.0 | 0.18 | 0.4 | 0.01 | 1.6 | 0.00 | 0.3 | 22 |
| 47 | Ex. | 94.81 | 3.0 | 0.18 | 0.4 | 0.01 | 1.6 | 0.00 | 0.1 | 21 |

As shown in Table 1, the test insulators 70 corresponding to the test Nos. 1, 2, 4, 6, 8-12, 15, 18-20, and 24-26 which satisfy all the expressions (1) to (6) described in claim 1 and are within the scope of the present invention have withstand voltage values not smaller than "25 kV", and achieve sufficient withstand voltage performance, whereas the test insulators 70 corresponding to the test Nos. 3, 5, 7, 13, 14, 16, 17, 21-23, and 27-29 which do not satisfy at least one of the expressions (1) to (6) described in claim 1 and are outside the scope of the present invention have withstand voltage values not larger than "23 kV" and do not achieve sufficient withstand voltage performance.

(High-Temperature Withstand Voltage Test II)

This test was performed in a manner similar to the "high-temperature withstand voltage test I" except that each test insulator 70 was put in the furnace and heated with the heater 73 until the temperature in the furnace reached 900° C., and a voltage of 25 kV was applied for 30 minutes at 900° C. between the test center electrode 74 and the annular member 72, followed by measurement of the withstand voltage value. In the high-temperature withstand voltage test II, the applied voltage value was higher and therefore the condition was severer than in the high-temperature withstand voltage test I. The results are shown in Table 4.

TABLE 4

| Test No. | | $R_{Al2O3}$ | $R_{SiO2}$ | $R_{MgO}$ | $R_{CaO}$ | $R_{SrO}$ | $R_{BaO}$ | $R_{La2O3}$ | $R_{MgO}/R_{BaO}$ | $R_{MgO}+R_{CaO}+R_{SrO}$ | Rca/ $(R_{MgO}+R_{CaO}+R_{SrO}+R_{BaO})$ | After application of 20 kV at 900° C. for 30 min Withstand voltage value (kV) |
|---|---|---|---|---|---|---|---|---|---|---|---|---|
| | | (mass %) | | | | | | | | | | |
| 51 | Ex. | 94.81 | 3.0 | 0.18 | 0.40 | 0.01 | 1.6 | 0.00 | 0.113 | 0.59 | 0.183 | 28 |
| 52 | Ex. | 94.61 | 3.0 | 0.18 | 0.60 | 0.01 | 1.6 | 0.00 | 0.113 | 0.79 | 0.251 | 27 |
| 53 | Ex. | 94.91 | 3.0 | 0.18 | 0.30 | 0.01 | 1.6 | 0.00 | 0.113 | 0.49 | 0.144 | 27 |
| 54 | Com. Ex. | 95.16 | 3.0 | 0.18 | 0.05 | 0.01 | 1.6 | 0.00 | 0.113 | 0.24 | 0.027 | 18 |
| 55 | Com. Ex. | 90.21 | 3.0 | 0.18 | 5.00 | 0.01 | 1.6 | 0.00 | 0.113 | 5.19 | 0.736 | 18 |
| 56 | Com. Ex. | 93.39 | 3.0 | 0.00 | 3.00 | 0.01 | 0.6 | 0.00 | 0.000 | 3.01 | 0.831 | 18 |
| 57 | Ex. | 93.67 | 3.0 | 0.18 | 0.34 | 0.01 | 2.8 | 0.00 | 0.064 | 0.53 | 0.102 | 23 |
| 58 | Ex. | 94.99 | 3.0 | 0.18 | 0.22 | 0.01 | 1.6 | 0.00 | 0.113 | 0.41 | 0.109 | 26 |
| 59 | Ex. | 94.46 | 3.0 | 0.18 | 0.35 | 0.01 | 2.0 | 0.00 | 0.090 | 0.54 | 0.138 | 26 |
| 60 | Ex. | 93.62 | 3.0 | 0.18 | 0.40 | 0.80 | 2.0 | 0.00 | 0.090 | 1.38 | 0.118 | 26 |
| 61 | Ex. | 93.98 | 3.0 | 0.18 | 1.43 | 0.01 | 1.4 | 0.00 | 0.129 | 1.62 | 0.474 | 26 |
| 62 | Ex. | 94.79 | 3.0 | 0.10 | 1.10 | 0.01 | 1.0 | 0.00 | 0.100 | 1.21 | 0.498 | 26 |
| 63 | Ex. | 96.09 | 3.0 | 0.00 | 0.40 | 0.01 | 0.5 | 0.00 | 0.000 | 0.41 | 0.440 | 26 |

As shown in Table 2, the test insulators 70 corresponding to the test Nos. 31 to 35 in which formation of barium hexaaluminate ($BaO.6Al_2O_3$) is confirmed have withstand voltage values not smaller than "25 kV" and achieve sufficient withstand voltage performance, whereas the test insulators 70 corresponding to the test Nos. 36 and 37 in which formation of barium hexaaluminate ($BaO.6Al_2O_3$) is not confirmed have withstand voltage values not larger than "22 kV" and do not achieve sufficient withstand voltage performance.

As shown in Table 3, the test insulators 70 corresponding to the test Nos. 41 to 45 in which the ratio ($D_A/D_B$) between the average grain size $D_A$ of the alumina crystal grains and the average grain size $D_B$ of the crystal grains containing the Ba component is not smaller than "0.5" have withstand voltage values not smaller than "25 kV" and achieve sufficient withstand voltage performance, whereas the test insulators 70 corresponding to the test Nos. 46 and 47 in which the ratio ($D_A/D_B$) is not larger than "0.5" have withstand voltage values not larger than "22 kV" and do not achieve sufficient withstand voltage performance.

As shown in Table 4, the test insulators 70 corresponding to the test Nos. 51-53 and 57-63 which satisfy all the expressions (1) to (7) described in claims have withstand voltage values not smaller than "20 kV" and achieve sufficient withstand voltage performance, whereas the test insulators 70 corresponding to the test Nos. 54-56 which do not satisfy the expressions (5) and (7) described in claims have withstand voltage values of "18 kV" and do not achieve sufficient withstand voltage performance.

(High-Temperature Withstand Voltage Test III)

This test was performed in a manner similar to the "high-temperature withstand voltage test I" except that each test insulator 70 was put in the furnace and heated with the heater 73 until the temperature in the furnace reached 900° C., and a voltage of 20 kV was applied for 60 minutes at 900° C. between the test center electrode 74 and the annular member 72, followed by measurement of the withstand voltage value. In the high-temperature withstand voltage test III, the voltage was applied for a longer term and therefore the condition was severer than in the high-temperature withstand voltage test I. The results are shown in Table 5.

TABLE 5

| Test No. | | $R_{Al2O3}$ | $R_{SiO2}$ | $R_{MgO}$ | $R_{CaO}$ | $R_{SrO}$ | $R_{BaO}$ | $R_{La2O3}$ | $R_{MgO}/R_{BaO}$ | $R_{MgO}+R_{CaO}+R_{SrO}$ | Rca/ $(R_{MgO}+R_{CaO}+R_{SrO}+R_{BaO})$ | $(R_{MgO}+R_{CaO}+R_{SrO})/R_{BaO}$ | After application of 20 kV at 900° C. for 60 min Withstand voltage value (kV) |
|---|---|---|---|---|---|---|---|---|---|---|---|---|---|
| | | (mass %) | | | | | | | | | | | |
| 71 | Ex. | 94.81 | 3.0 | 0.18 | 0.4 | 0.01 | 1.60 | 0.00 | 0.113 | 0.59 | 0.183 | 0.37 | 28 |
| 72 | Ex. | 94.62 | 3.0 | 0.18 | 0.5 | 0.10 | 1.60 | 0.00 | 0.113 | 0.78 | 0.210 | 0.49 | 28 |
| 73 | Ex. | 95.02 | 3.0 | 0.18 | 0.5 | 0.10 | 1.20 | 0.00 | 0.150 | 0.78 | 0.253 | 0.65 | 28 |
| 74 | Ex. | 95.66 | 3.0 | 0.18 | 0.5 | 0.01 | 0.65 | 0.00 | 0.277 | 0.69 | 0.373 | 1.06 | 24 |
| 75 | Ex. | 95.82 | 3.0 | 0.18 | 0.4 | 0.10 | 0.50 | 0.00 | 0.360 | 0.68 | 0.339 | 1.36 | 18 |
| 76 | Ex. | 93.97 | 3.0 | 0.18 | 0.8 | 0.70 | 1.35 | 0.00 | 0.133 | 1.68 | 0.264 | 1.24 | 23 |
| 77 | Ex. | 95.82 | 3.0 | 0.18 | 0.2 | 0.10 | 0.70 | 0.00 | 0.257 | 0.48 | 0.169 | 0.69 | 25 |
| 78 | Com. Ex. | 94.30 | 3.0 | 0.30 | 0.4 | 1.00 | 1.00 | 0.00 | 0.300 | 1.70 | 0.148 | 1.70 | 18 |
| 79 | Com. Ex. | 94.50 | 3.0 | 0.50 | 0.5 | 0.50 | 1.00 | 0.00 | 0.500 | 1.50 | 0.200 | 1.50 | 18 |
| 80 | Ex. | 93.31 | 3.0 | 0.18 | 0.5 | 0.01 | 3.00 | 0.00 | 0.060 | 0.69 | 0.136 | 0.23 | 28 |
| 81 | Ex. | 90.81 | 3.0 | 0.18 | 1.0 | 0.01 | 5.00 | 0.00 | 0.036 | 1.19 | 0.162 | 0.24 | 28 |

As shown in Table 5, the test insulators 70 corresponding to the test Nos. 71, 74, 76, 77, 80 and 81 which satisfy all the expressions (1) to (8) described in claims have withstand voltage values not smaller than "20 kV" and achieve sufficient withstand voltage performance, whereas the test insulators 70 corresponding to the test Nos. 75, 78 and 79 which do not satisfy the expression (8) described in claim have withstand voltage values of "18 kV" and do not achieve sufficient withstand voltage performance.

(High-Temperature Withstand Voltage Test IV)

This test was performed in a manner similar to the "high-temperature withstand voltage test I" except that each test insulator 70 was put in the furnace and heated with the heater 73 until the temperature in the furnace reached 900° C., and a voltage of 20 kV was applied for 120 minutes at 900° C. between the test center electrode 74 and the annular member 72, followed by measurement of a withstand voltage value. In the high-temperature withstand voltage test IV, the voltage was applied for a longer term and therefore the condition was severer than in the high-temperature withstand voltage test I. The results are shown in Tables 6 and 7.

TABLE 6

| Test No. | | $R_{Al2O3}$ | $R_{SiO2}$ | $R_{MgO}$ | $R_{CaO}$ | $R_{SrO}$ | $R_{BaO}$ | $R_{La2O3}$ | Na | K | $R_{MgO}/R_{BaO}$ | $R_{MgO}+R_{CaO}+R_{SrO}$ | Rca/ $(R_{MgO}+R_{CaO}+R_{SrO}+R_{BaO})$ | $(R_{MgO}+R_{CaO}+R_{SrO})/R_{BaO}$ | Na + K | After application of 20 kV at 900° C. for 120 min Withstand voltage value (kV) |
|---|---|---|---|---|---|---|---|---|---|---|---|---|---|---|---|---|
| | | (mass %) | | | | | | | | | | | | | | |
| 91 | Ex. | 94.81 | 3.0 | 0.18 | 0.4 | 0.01 | 1.6 | 0.00 | 0.001 | 0.001 | 0.113 | 0.59 | 0.183 | 0.37 | 0.002 | 32 |
| 92 | Ex. | 94.81 | 3.0 | 0.18 | 0.4 | 0.01 | 1.6 | 0.00 | 0.001 | 0.010 | 0.113 | 0.59 | 0.183 | 0.37 | 0.011 | 30 |
| 93 | Ex. | 94.81 | 3.0 | 0.18 | 0.4 | 0.01 | 1.6 | 0.00 | 0.010 | 0.001 | 0.113 | 0.59 | 0.183 | 0.37 | 0.011 | 30 |
| 94 | Ex. | 94.81 | 3.0 | 0.18 | 0.4 | 0.01 | 1.6 | 0.00 | 0.010 | 0.010 | 0.113 | 0.59 | 0.183 | 0.37 | 0.020 | 29 |
| 95 | Ex. | 94.81 | 3.0 | 0.18 | 0.4 | 0.01 | 1.6 | 0.00 | 0.025 | 0.025 | 0.113 | 0.59 | 0.183 | 0.37 | 0.050 | 29 |
| 96 | Ex. | 94.81 | 3.0 | 0.18 | 0.4 | 0.01 | 1.6 | 0.00 | 0.040 | 0.010 | 0.113 | 0.59 | 0.183 | 0.37 | 0.050 | 29 |
| 97 | Ex. | 94.81 | 3.0 | 0.18 | 0.4 | 0.01 | 1.6 | 0.00 | 0.010 | 0.040 | 0.113 | 0.59 | 0.183 | 0.37 | 0.050 | 28 |
| 98 | Ex. | 94.81 | 3.0 | 0.18 | 0.4 | 0.01 | 1.6 | 0.00 | 0.100 | 0.001 | 0.113 | 0.59 | 0.183 | 0.37 | 0.101 | 19 |
| 99 | Ex. | 94.81 | 3.0 | 0.18 | 0.4 | 0.01 | 1.6 | 0.00 | 0.001 | 0.100 | 0.113 | 0.59 | 0.183 | 0.37 | 0.101 | 19 |
| 100 | Ex. | 94.81 | 3.0 | 0.18 | 0.4 | 0.01 | 1.6 | 0.00 | 0.100 | 0.100 | 0.113 | 0.59 | 0.183 | 0.37 | 0.200 | 17 |
| 101 | Ex. | 94.81 | 3.0 | 0.18 | 0.4 | 0.01 | 1.6 | 0.00 | 1.000 | 1.000 | 0.113 | 0.59 | 0.183 | 0.37 | 2.000 | 15 |

As shown in Table 6, the test insulators 70 corresponding to the test Nos. 91 to 97 which satisfy all the expressions (1) to (8) described in claims and in which the sum of the content ratios of Na and K is not less than 0.002 mass % and not greater than 0.050 mass %, have withstand voltage values not smaller than "25 kV" and achieve sufficient withstand voltage performance, whereas the test insulators 70 corresponding to the test Nos. 98 to 101 in which the sum of the content ratios of Na and K exceeds 0.050 mass % have withstand voltage values not larger than "19 kV" and do not achieve sufficient withstand voltage performance.

TABLE 7

| Test No. | | $R_{Al2O3}$ | $R_{SiO2}$ | $R_{MgO}$ | $R_{CaO}$ | $R_{SrO}$ | $R_{BaO}$ (mass %) | $R_{La2O3}$ | Na | K | Fe | Ti |
|---|---|---|---|---|---|---|---|---|---|---|---|---|
| 111 | Ex. | 94.81 | 3.0 | 0.18 | 0.4 | 0.01 | 1.6 | 0.00 | 0.002 | 0.002 | 0.01 | 0.00 |
| 112 | Ex. | 94.81 | 3.0 | 0.18 | 0.4 | 0.01 | 1.6 | 0.00 | 0.002 | 0.002 | 0.02 | 0.00 |
| 113 | Ex. | 94.81 | 3.0 | 0.18 | 0.4 | 0.01 | 1.6 | 0.00 | 0.002 | 0.002 | 0.03 | 0.00 |
| 114 | Ex. | 94.81 | 3.0 | 0.18 | 0.4 | 0.01 | 1.6 | 0.00 | 0.002 | 0.002 | 0.05 | 0.00 |
| 115 | Ex. | 94.81 | 3.0 | 0.18 | 0.4 | 0.01 | 1.6 | 0.00 | 0.002 | 0.002 | 0.07 | 0.00 |
| 116 | Ex. | 94.81 | 3.0 | 0.18 | 0.4 | 0.01 | 1.6 | 0.00 | 0.002 | 0.002 | 0.01 | 0.01 |
| 117 | Ex. | 94.81 | 3.0 | 0.18 | 0.4 | 0.01 | 1.6 | 0.00 | 0.002 | 0.002 | 0.01 | 0.04 |
| 118 | Ex. | 94.81 | 3.0 | 0.18 | 0.4 | 0.01 | 1.6 | 0.00 | 0.002 | 0.002 | 0.01 | 0.07 |
| 119 | Ex. | 94.81 | 3.0 | 0.18 | 0.4 | 0.01 | 1.6 | 0.00 | 0.002 | 0.002 | 0.04 | 0.04 |
| 120 | Ex. | 94.81 | 3.0 | 0.18 | 0.4 | 0.01 | 1.6 | 0.00 | 0.002 | 0.002 | 0.06 | 0.06 |
| 121 | Ex. | 94.81 | 3.0 | 0.18 | 0.4 | 0.01 | 1.6 | 0.00 | 0.002 | 0.002 | 0.10 | 0.10 |

| Test No. | | $R_{MgO}/R_{BaO}$ | $R_{MgO}+R_{CaO}+R_{SrO}$ | Rca/($R_{MgO}+R_{CaO}+R_{SrO}+R_{BaO}$) | ($R_{MgO}+R_{CaO}+R_{SrO}$)/$R_{BaO}$ | Na + K | Fe + Ti | After application of 20 kV at 900° C. for 120 min Withstand voltage value (kV) |
|---|---|---|---|---|---|---|---|---|
| 111 | Ex. | 0.113 | 0.59 | 0.183 | 0.37 | 0.004 | 0.011 | 32 |
| 112 | Ex. | 0.113 | 0.59 | 0.183 | 0.37 | 0.004 | 0.021 | 30 |
| 113 | Ex. | 0.113 | 0.59 | 0.183 | 0.37 | 0.004 | 0.031 | 30 |
| 114 | Ex. | 0.113 | 0.59 | 0.183 | 0.37 | 0.004 | 0.051 | 29 |
| 115 | Ex. | 0.113 | 0.59 | 0.183 | 0.37 | 0.004 | 0.071 | 29 |
| 116 | Ex. | 0.113 | 0.59 | 0.183 | 0.37 | 0.004 | 0.020 | 29 |
| 117 | Ex. | 0.113 | 0.59 | 0.183 | 0.37 | 0.004 | 0.050 | 28 |
| 118 | Ex. | 0.113 | 0.59 | 0.183 | 0.37 | 0.004 | 0.080 | 28 |
| 119 | Ex. | 0.113 | 0.59 | 0.183 | 0.37 | 0.004 | 0.080 | 28 |
| 120 | Ex. | 0.113 | 0.59 | 0.183 | 0.37 | 0.004 | 0.120 | 17 |
| 121 | Ex. | 0.113 | 0.59 | 0.183 | 0.37 | 0.004 | 0.200 | 15 |

As shown in Table 7, the test insulators 70 corresponding to the test Nos. 111 to 119 which satisfy all the expressions (1) to (8) described in claims and in which the sum of the content ratios of Na and K is not less than 0.002 mass % and not greater than 0.050 mass % and the sum of the content ratios of the Fe component and the Ti component is not less than 0.01 mass % and not greater than 0.08 mass %, have withstand voltage values not smaller than "25 kV" and achieve sufficient withstand voltage performance, whereas the test insulators 70 corresponding to the test Nos. 120 and 121 in which the sum of the content ratios of the Fe component and the Ti component exceeds 0.08 mass % have withstand voltage values not larger than "17 kV" and do not achieve sufficient withstand voltage performance.

DESCRIPTION OF REFERENCE NUMERALS

1 spark plug
2 axial bore
3 insulator
4 center electrode
5 metal terminal
6 connection portion
7 metallic shell
8 ground electrode
11 rear trunk portion
12 large diameter portion
13 front trunk portion
14 leg portion
24 screw portion
25 gas seal portion
26 tool engagement portion
27 crimping portion
28 rear end portion
29 rod-shaped portion
70 test insulator
71 withstand voltage measuring apparatus
72 annular member
73 heater
74 test center electrode
G gap

The invention claimed is:

1. A spark plug comprising:

an insulator having an axial bore extending in a direction of an axis;

a center electrode provided at a front side of the axial bore;

a metallic shell provided on an outer periphery of the insulator; and a ground electrode fixed to a front end of the metallic shell, wherein the insulator is made of an alumina sintered body containing $Al_2O_3$ as a principal component and further containing additional components including an Si component, a Ba component, an Mg component, a Ca component, an Sr component, a rare earth element component, and barium hexaaluminate, and when the additional components are expressed as oxides including $R_{SiO2}$, $R_{BaO}$, $R_{MgO}$, $R_{CaO}$, $R_{SrO}$, and $R_{RE2O3}$, contents (mass %) of the additional components satisfy expressions (1) to (6) as follows:

$$1.0 \leq R_{SiO2} \leq 5.0 \quad (1)$$

$$0.5 \leq R_{BaO} \leq 5.0 \quad (2)$$

$$0 \leq R_{MgO} \leq 0.18 \quad (3)$$

$$0 \leq R_{MgO}/R_{BaO} \leq 0.36 \quad (4)$$

$$0.3 \leq (R_{MgO}+R_{CaO}+R_{SrO}) \leq 1.8 \quad (5)$$

$$0 \leq R_{RE2O3} \leq 0.1 \quad (6).$$

2. The spark plug according to claim 1, wherein the contents of the additional components satisfy an expression (7) as follows:

$$0.10 \leq R_{CaO}/(R_{MgO}+R_{CaO}+R_{SrO}+R_{BaO}) \leq 0.50 \quad (7).$$

3. The spark plug according to claim 1, wherein the contents of additional components satisfy an expression (8) as follows:

$$0.06 \leq (R_{MgO}+R_{CaO}+R_{SrO})/R_{BaO} \leq 1.25 \quad (8).$$

4. The spark plug according to claim 1, wherein the alumina sintered body further contains a Na component and a K component whose combined content is not less than 0.002 mass % and not greater than 0.050 mass %.

5. The spark plug according to claim 1, wherein the alumina sintered body further contains a Ti component and an Fe component whose combined content is not less than 0.01 mass % and not greater than 0.08 mass %.

6. The spark plug according to claim 1, wherein the alumina sintered body has a ratio $D_A/D_B$ that is not smaller than 0.5 and not larger than 5.0, where $D_A$ is an average value of maximum diameters of a plurality of alumina crystal grains, and $D_B$ is an average value of maximum diameters of crystal grains containing the Ba component.

* * * * *